US010859021B2

(12) United States Patent
Ono et al.

(10) Patent No.: US 10,859,021 B2
(45) Date of Patent: Dec. 8, 2020

(54) APPARATUS FOR CONTROLLING AIR FUEL RATIO

(71) Applicant: DENSO CORPORATION, Kariya (JP)

(72) Inventors: Yoshihisa Ono, Kariya (JP); Hiroshi Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 199 days.

(21) Appl. No.: 16/011,815

(22) Filed: Jun. 19, 2018

(65) Prior Publication Data

US 2018/0363582 A1 Dec. 20, 2018

(30) Foreign Application Priority Data

Jun. 20, 2017 (JP) ..... 2017-120176

(51) Int. Cl.

| | |
|---|---|
| ***F01N 3/00*** | (2006.01) |
| ***F02D 41/14*** | (2006.01) |
| ***F02D 41/24*** | (2006.01) |
| ***F02D 41/40*** | (2006.01) |
| *F02D 41/28* | (2006.01) |

(52) U.S. Cl.

CPC ..... *F02D 41/1454* (2013.01); *F02D 41/1441* (2013.01); *F02D 41/1445* (2013.01); *F02D 41/1473* (2013.01); *F02D 41/1475* (2013.01); *F02D 41/2454* (2013.01); *F02D 41/401* (2013.01); *F02D 2041/281* (2013.01); *F02D 2041/286* (2013.01)

(58) Field of Classification Search

CPC ..... F02D 41/1441; F02D 41/1445; F02D 41/1454; F02D 41/1473; F02D 41/1475; F02D 41/2454; F02D 41/401

USPC ..... 60/285

See application file for complete search history.

(56) References Cited

U.S. PATENT DOCUMENTS

| | | | | |
|---|---|---|---|---|
| 5,419,828 | A | 5/1995 | Nakano et al. | |
| 2003/0000206 | A1 * | 1/2003 | Takubo | F02D 41/0295 60/285 |

(Continued)

FOREIGN PATENT DOCUMENTS

| | | | |
|---|---|---|---|
| JP | H08-254146 | | 10/1996 |
| JP | H10-082760 | | 3/1998 |
| JP | 2006063840 | A * | 3/2006 |

(Continued)

OTHER PUBLICATIONS

English translation of JP 2006063840 (Year: 2006).*

*Primary Examiner* — Jason D Shanske

(74) *Attorney, Agent, or Firm* — Nixon & Vanderhye P.C.

(57) ABSTRACT

An air fuel ratio control apparatus controls an air fuel ratio of an internal combustion engine. The apparatus includes an upstream sensor measuring the air fuel ratio of exhaust gas in an exhaust passage at an upstream side of a purification catalyst; a downstream sensor measuring the air fuel ratio of the exhaust gas in the exhaust passage at a downstream side of the purification catalyst; and a control unit that adjusts an amount of fuel supplied to the internal combustion engine, thereby controlling the air fuel ratio measured at the upstream sensor to be a target air fuel ratio. The control unit performs a calibration control where a calibration value corresponding to the air fuel ratio deviation is added to or subtracted from the target air fuel ratio such that the air fuel ratio deviation approaches zero.

10 Claims, 8 Drawing Sheets

(56) References Cited

U.S. PATENT DOCUMENTS

| | | | | |
|---|---|---|---|---|
| 2004/0045282 | A1* | 3/2004 | Ide | F01N 3/101 60/285 |
| 2019/0285021 | A1* | 9/2019 | Suzuki | F02D 41/1445 |

FOREIGN PATENT DOCUMENTS

| | | |
|---|---|---|
| JP | 2013-072348 | 4/2013 |
| JP | 2015-071959 | 4/2015 |
| JP | 2015-172356 | 10/2015 |

* cited by examiner

APPARATUS FOR CONTROLLING AIR FUEL RATIO

CROSS-REFERENCE TO RELATED APPLICATION

This application is based on and claims the benefit of priority from earlier Japanese Patent Application No. 2017-120176 filed Jun. 20, 2017, the description of which is incorporated herein by reference.

BACKGROUND

Technical Field

The present disclosure relates to an apparatus for controlling air fuel ratio of an internal combustion engine.

Description of the Related Art

In a vehicle having an internal combustion engine as a driving force, an air fuel ratio control apparatus is provided to control an air fuel ratio. According to the air fuel ratio control apparatus, a sensor detects the air fuel ratio (oxygen concentration) of the exhaust gas passing through the exhaust passage and adjusts the fuel supply to the internal combustion engine such that the detected air fuel ratio becomes an appropriate value.

In the exhaust gas passage, a purification catalyst having oxygen occluding and releasing capability is provided, thereby purifying the exhaust gas. Generally, the sensor that measures the air fuel ratio is provided at both of a position in the upstream side than the purification catalyst located in the exhaust passage, and a position in the downstream side than the purification catalysis located in the exhaust gas passage.

For example, Japanese Patent Laid-Open Publication No. 2015-172356 discloses a control apparatus that adjusts the fuel supply to the internal combustion engine so as to control the air fuel ratio measured by the air fuel ratio sensor in the upstream side to be a predetermined target air fuel ratio. Usually, the above-mentioned target air fuel ratio is set to be on a rich side of the theoretical air fuel ratio. When the air fuel ratio measured by an air fuel ratio sensor in the downstream side becomes a rich side than the theoretical air fuel ratio, the above-mentioned air fuel ratio is temporarily changed to a lean side. Then, when air fuel ratio measured by an air fuel ratio sensor in the downstream side becomes the theoretical value, the target air fuel ratio is set to the rich side again.

Thus, in such a control, the air fuel ratio measured at the air fuel ratio sensor in the downstream side becomes a rich side value with a substantially constant frequency. At this time, the air fuel ratio of the exhaust gas is deviated from the highest purification efficiency of the purification catalyst so that the exhaust gas contains carbon mono oxide. In order to prevent such an exhaust gas from being emitted outside the vehicle, another purification catalyst for purifying the exhaust gas is provided in a further downstream side than the air fuel ratio sensor located in the downstream side.

According to the control apparatus disclosed in the above-mentioned patent literature, the target value of the air fuel ratio measured at the upstream side air fuel ratio sensor is alternately changed between a rich side value relative to the theoretical value and a lean side value relative to the theoretical air fuel ratio. As a result of such a control, the air fuel ratio measured at the downstream side air fuel ratio sensor frequently becomes a rich side value. In other words, the air fuel ratio of the exhaust gas passing through the purification catalyst is frequently deviated from the highest purification efficiency.

SUMMARY

Hence, it is desired to provide an air fuel ratio control apparatus capable of reducing an occurrence frequency of a phenomenon where the air fuel ratio of the exhaust gas passing through the purification catalyst is deviated from the highest purification efficiency.

An air fuel ratio control apparatus according to the present disclosure is an air fuel ratio control apparatus that controls an air fuel ratio of an internal combustion engine. The apparatus includes: an upstream sensor measuring the air fuel ratio of an exhaust gas in an exhaust passage at an upstream side of a purification catalyst purifying the exhaust gas, the exhaust gas being discharged from the internal combustion engine and passing through the exhaust passage; a downstream sensor measuring the air fuel ratio of the exhaust gas in the exhaust passage at a downstream side of the purification catalyst; and a control unit that adjusts an amount of fuel supplied to the internal combustion engine, thereby controlling the air fuel ratio measured at the upstream sensor to be a target air fuel ratio, in which an air fuel ratio deviation is defined as a difference between the air fuel ratio measured by the downstream sensor and an air fuel ratio corresponding to a highest purification efficiency in the purification catalyst; and the control unit is configured to perform a calibration control in which a calibration value corresponding to the air fuel ratio deviation is added to or subtracted from the target air fuel ratio such that the air fuel ratio deviation approaches 0.

In such a calibration control, as a calibration value used for adding to or subtracting from the target air fuel ratio, a value corresponding to an air fuel ratio deviation, that is, an optimized value is set to control the air fuel ratio deviation to be 0. This calibration control is performed for several times as needed, whereby the air fuel ratio deviation can be 0 within a short period of time. In other words, the control allows the air fuel ratio measured at the downstream sensor to reach the highest purification efficiency in a short period of time.

For the above-described "a calibration value corresponding to the air fuel ratio deviation", the air fuel ratio deviation itself can be used, or a value in which a predetermined coefficient is multiplied by the air fuel ratio deviation can be used.

Immediately after the calibration control is performed, the air fuel ratio of the exhaust gas passing through the purification catalyst is substantially the same as a value corresponding to the highest purification efficiency of the purification catalyst. Thus, it takes longer time to next occurrence of a phenomena in which the air fuel ratio of the exhaust gas is deviated from the highest purification efficiency. As a result, according to the above-descried air fuel ratio control apparatus, frequency of occurrence of the phenomena in which the air fuel ratio of exhaust gas passing through the purification catalyst is deviated from the highest purification efficiency of the upstream side purification catalyst can be lower than that of conventional technique.

According to the present disclosure, an air fuel ratio control apparatus capable of reducing the frequency of occurrence of the phenomena in which the air fuel ratio of exhaust gas passing through the purification catalyst is deviated from the highest purification efficiency of the upstream side purification catalyst.

DETAILED DESCRIPTION OF THE PREFERRED EMBODIMENTS

Figure 1:
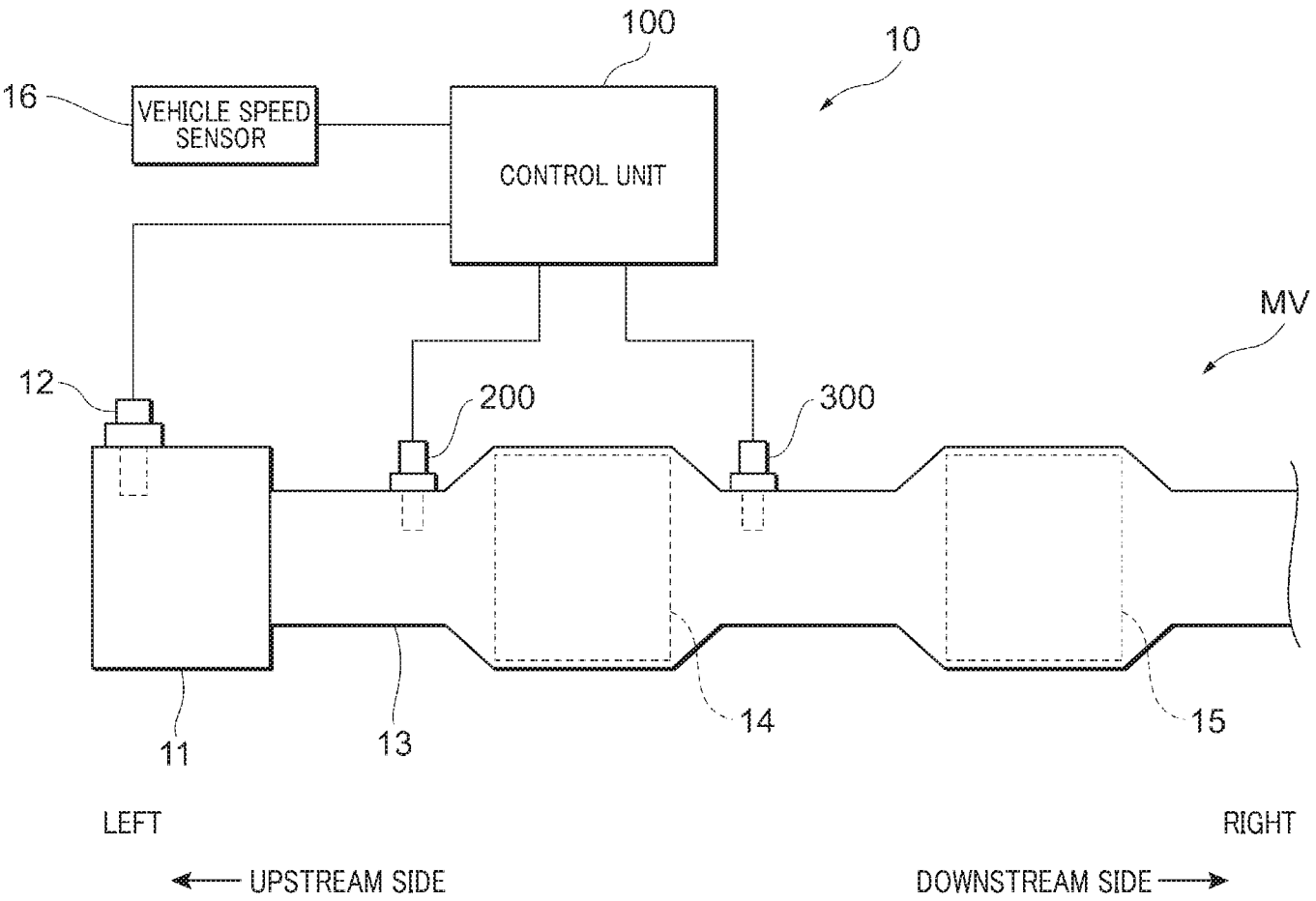
FIG. 1 is a diagram showing an overall configuration of an air fuel ratio control apparatus according to a first embodiment of the present disclosure.

Hereinafter, with reference to the drawings, embodiments of the present disclosure will be described. To facilitate understanding of the description, the same reference symbols are added to the same elements in each drawing as much as possible, and redundant explanations will be omitted.

First Embodiment

A first embodiment will be described in the followings. An air fuel ratio control apparatus 10 according to the first embodiment is included in a vehicle MV (entire configuration is not shown), and configured as an apparatus to control the air fuel ratio of an internal combustion engine 11. Prior to describing the configuration of the air fuel ratio control apparatus 10, a configuration of the vehicle MV will be described. The vehicle MV is provided with the internal combustion engine 11, an exhaust passage 13, an upstream side purification catalyst 14, a downstream side purification catalyst 15 and a vehicle speed sensor 16.

In the internal combustion engine 11 as a so-called engine, fuel is supplied together with air and combusted inside thereof, thereby generating a driving force of the vehicle MV. A fuel supply to the internal combustion engine 11 is performed by the injector 12 which serves as a fuel injection valve. The fuel is supplied to the internal combustion engine 11 during the injector 12 being opened, and the fuel supply is stopped when the injector 12 is in closed state. The air fuel ratio varies depending on a change in an amount of fuel supplied from the injector 12. Opening and closing the injector 12 is controlled by a control unit 100 which will be described later.

The exhaust passage 13 is a pipe that introduces an exhaust gas produced in the internal combustion engine 11 towards outside the vehicle MV, thereby discharging the exhaust gas. The exhaust gas flows from the left side to the right side in FIG. 1.

Each of the upstream side purification catalyst 14 and the downstream side purification catalyst 15 is configured of a three-dimensional catalyst. These purification catalysts 14 and 15 each have a configuration that supports, on the base material composed of ceramic, noble metal such as platinum having catalytic action, a support member such as alumina that supports the noble metal and a substance such as ceria having oxygen occluding and releasing capability. The upstream side purification catalyst 14 and the downstream side purification catalyst 15 purify unburned gas such as hydrocarbon and carbon mono oxide, and nitrogen oxides simultaneously, when the temperature thereof reaches a predetermined activation temperature.

The upstream side purification catalyst 14 and the downstream side purification catalyst 15 are arranged to be along an exhaust gas flow in the exhaust gas flow 13. The downstream side purification catalyst 15 is disposed in a downstream side than the upstream purification catalyst 14.

The vehicle speed sensor 16 is a sensor that detects a travelling speed of the vehicle MV (i.e., vehicle speed). The travelling speed measured at the vehicle speed sensor 16 is inputted to the control unit 100. Note that various sensors other than the vehicle speed sensor 16 are mounted in the vehicle, in which respective measurement values of the various sensors are inputted to the control unit 100. However, these configurations are omitted in FIG. 1.

Next, with reference to FIG. 1, a configuration of the air fuel ratio control apparatus 10 will be described. The air fuel ratio control apparatus 10 is provided with an upstream sensor 200, a downstream sensor 300 and a control unit 100.

The upstream sensor 200 is a sensor (air fuel ratio sensor) that measures the air fuel ratio of the exhaust gas passing through the exhaust gas passage 13. The upstream sensor 200 is configured such that the output current varies depending on the air fuel ratio of the exhaust gas (i.e., oxygen concentration). In the exhaust gas passage 13, the upstream sensor 200 is disposed in a further upstream side than the upstream side purification catalyst 14 is located. In other words, the upstream sensor 200 is provided as a sensor to detect the air fuel ratio of the exhaust gas in the upstream side than the upstream side catalyst 14 that purifies the exhaust gas in the exhaust passage 13. Specific configuration of the upstream sensor 200 will be described later.

Similar to the upstream sensor 200, the downstream sensor 300 is a sensor that measures the air fuel ratio of the exhaust gas passing through the exhaust gas passage 13 (air fuel ratio sensor). The configuration of the downstream sensor 300 is the same as that of the upstream sensor 200. In the exhaust passage 13, the downstream sensor 300 is disposed in a downstream side than the upstream side purification catalyst 14 is located and in an upstream side than the downstream side purification catalyst 15 is located. That is, the downstream sensor 300 is provided as a sensor to detect the air fuel ratio of the exhaust gas in the downstream side than the upstream side catalyst 14 that purifies the exhaust gas in the exhaust passage 13.

The control unit 100 serves as a control part that controls the overall operation of the air fuel ratio control apparatus 10. The control unit 100 is configured of a computer system including CPU, ROM, RAM and the like. The control unit 100 adjusts the fuel supply to the internal combustion engine 11 by controlling the injector 12 to be opened or closed, thereby controlling the air fuel ratio measured at the upstream sensor 200 to be the target air fuel ratio.

For example, in the case where the air fuel ratio measured at the upstream sensor 200 is smaller than the target air fuel ratio (that is, rich side value than the target air fuel ratio), the control unit 100 shortens period for opening (open period) the injector 12. Thus, an amount of the fuel supply to the internal combustion engine 11 is reduced so that the air fuel ratio measured at the upstream sensor 200 increases to approach the target air fuel ratio.

In contrast, when the air fuel ratio measured at the upstream sensor 200 is larger than the target air fuel ratio (lean side than the target air fuel ratio), the control unit 100 changes period for opening the injector 12 to be longer. Thus, the amount of fuel supply to the internal combustion engine increases so that the air fuel ratio measured at the upstream sensor 200 decreases to approach the target air fuel ratio.

As the target air fuel ratio, so-called theoretical air fuel ratio or near the theoretical air fuel ratio is set. The target air fuel ratio may be a constant value or a value which is constantly changed. According to the present embodiment, as will be described later, the target air fuel ratio may be changed (calibrated) based on the air fuel ratio measured at the downstream sensor 300.

In order to maintain the activation of the catalyst, a variation of air fuel ratio with constant periods (perturbation control) may be added thereto. However, an averaged value of the air fuel ratio which is varied during the constant periods becomes the same value as the above-described target air fuel ratio.

Figure 2:
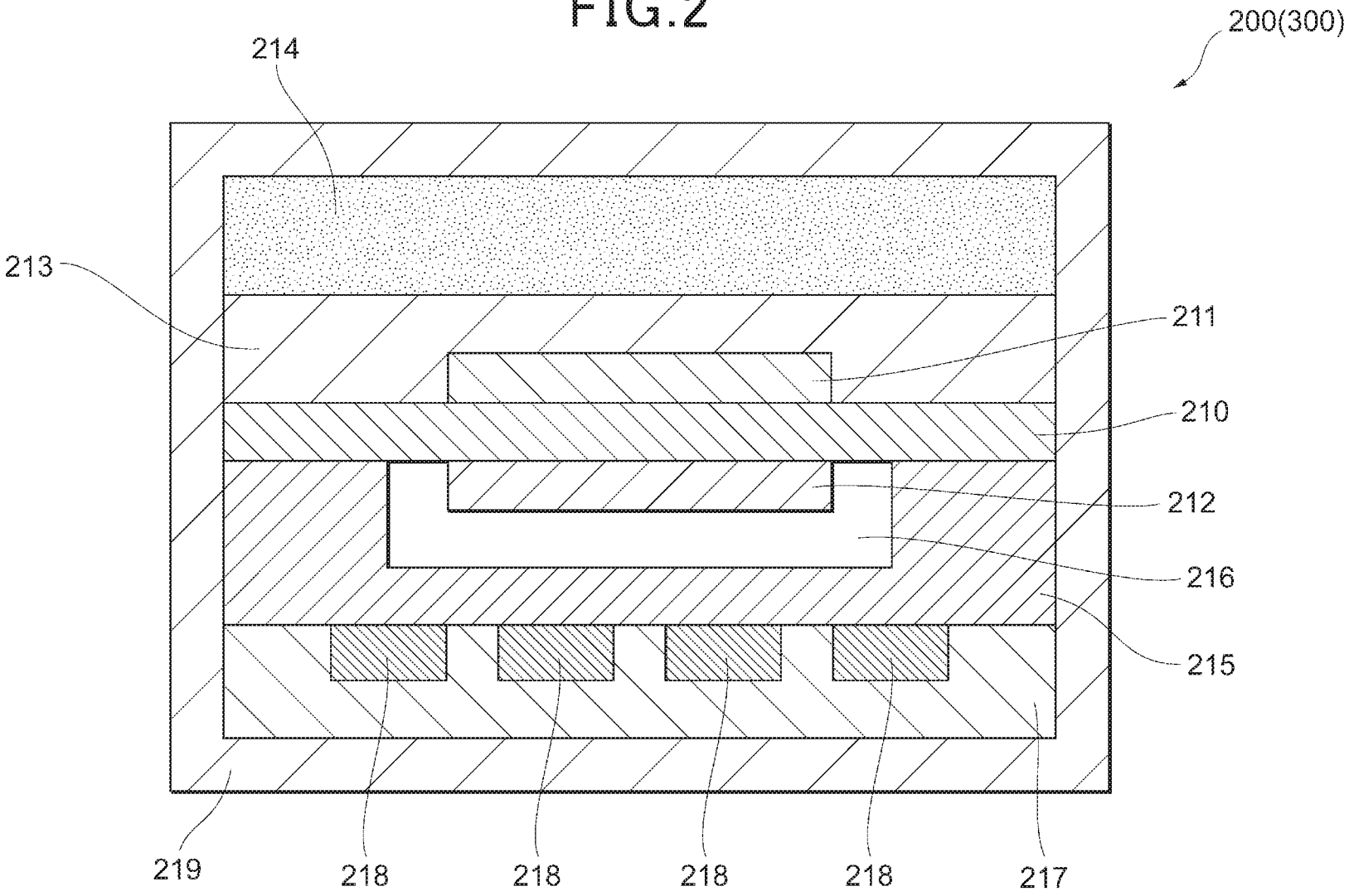
FIG. 2 is a diagram showing an internal configuration of an air fuel ratio sensor included in the air fuel ratio control apparatus shown in FIG. 1.

With reference to FIG. 2, a configuration of the upstream sensor 200 will be described. Note that the configuration of the downstream sensor 300 is the same as the configuration of the upstream sensor 200. Hence, hereinafter, only the upstream sensor 200 will be described and the explanation of the downstream sensor 300 will be omitted.

The upstream sensor 200 is configured as a plate-type air fuel ratio sensor having one cell structure. In FIG. 2, a cross section is shown for a part of the upstream sensor 200 which is arranged in the exhaust passage 13. Note that the configuration of the upstream sensor 200 is the same as the configuration disclosed in Japanese Patent Application Laid-Open Publication No. 1995-120429.

The upstream sensor 200 includes a solid electrolyte 210, an operation electrode 211, a reference electrode 212 and a heater 218.

The solid electrolyte 210 is made of partially stabilized zirconia formed in a sheet-like shape. The solid electrolyte 210 has oxygen ion electrical conductivity at a predetermined activation temperature. The upstream sensor 200 is configured to measure the air fuel ratio of the exhaust gas by utilizing properties of the solid electrolyte 210 in which an amount of oxygen ion passing through the solid electrolyte varies depending on the air fuel ratio (oxygen concentration) of the exhaust gas.

The operation electrode 211 is a layer formed on a surface of one side (upper side in FIG. 2) of the solid electrolyte 210. The operation electrode 211 is formed of a porous layer which is made of platinum or the like. Accordingly, the operation electrode 211 has both of electrical conductivity and permeability.

A gas transmission layer 213 is provided to cover around the operation electrode 211. The gas transmission layer 213 is made of anti-heat ceramics having porosity, covering the entire surface of the solid electrolyte 210 on which the operation electrode 211 is formed. In the gas transmission layer 213, a surface opposite to the solid electrolyte 210 is covered by a gas shielding layer 214. The gas shielding layer 214 is a layer made of anti-heat ceramic having porosity similar to the transmission layer 213, where the porosity is smaller than the porosity of the gas transmission layer 213. Hence, the exhaust gas passing through the exhaust gas 13 enters inside the gas transmission layer 213 from a side surface which opens the gas transmission layer 213 (surface where the gas shielding layer 214 does not cover), and reaches the solid electrolyte 210 via the operation electrode 211.

The reference electrode 212 is a layer formed on a surface opposite to the operation electrode 211 side in the solid electrolyte 210 (downward side in FIG. 2). Similar to the operation electrode 211, the reference electrode 212 is a layer having porosity made of platinum or the like. Hence, the reference electrode 212 has both electrical conductivity and permeability.

In the solid electrolyte 210, a surface on which the reference electrode 212 is formed is covered by a duct 215. The duct 215 is a layer made of alumina and is formed by an injection molding. An air passage 216 which is a space isolated from the exhaust passage 13 is formed inside the duct 215. Specifically, the air passage 216 is formed between the duct 215 and the reference electrode 212. The outside air is introduced into the air passage 216. Thus, the solid electrolyte 210 is formed such that one surface is exposed to the exhaust gas passing through the exhaust passage 13 and the other surface is exposed to the outside air. In the solid electrolyte 210, transportation of oxygen ions occurs due to the difference of oxygen concentrations between respective surfaces thereof.

The heater 218 is powered to generate heat, thereby maintaining the solid electrolyte 210 to be the activation temperature. The heater 218 according to the present embodiment is formed by a mixture of platinum and alumina. An amount of power supplied to the heater 218, that is, heat quantity of the heater 218, is adjusted by the control unit 100. An insulation layer 217 composed of alumina having high purity is provided to cover around the heater 218.

Other configurations of the upstream sensor 200 will be described. The outer side part of the above-described upstream sensor 200 is covered by a protection layer 219. The protection layer 219 prevents the gas transmission layer 213 from being clogged due to condensed components of the exhaust gas. The protection layer 210 is formed of a high surface area alumina by using a dip method or a plasma spraying method. In view of preventing the clogging of the gas transmission layer 213, only the side surface of the gas transmission layer 213 may be covered with the protection layer 219. However, according to the present embodiment, in order to improve moisture retaining properties, portions other than the side surface of the gas transmission layer 213 may be covered with the protection layer 219 as well.

Further outside the protection layer 219 is covered by a cover (not shown) formed of stainless. The cover includes a plurality of openings formed therein, through which the exhaust gas flows to enter inside the cover.

When the upstream sensor measures the air fuel ratio, a predetermined voltage is applied between the operation electrode 211 and the reference electrode 212. At this time, in the solid electrolyte 210, a transportation of oxygen ions occurs due to the difference of oxygen concentrations between the operation electrode 211 side (i.e., exhaust gas oxygen concentration) and the reference electrode 212 side (i.e., oxygen concentration of atmospheric air). As a result, output current flows between the operation electrode 211 and the reference electrode 212, an amount of the output current being substantially proportional to the air fuel ratio of the exhaust gas. Thus, the upstream sensor 200 and the downstream sensor 300 are each configured such that the output current thereof is proportional to the air fuel ratio of the exhaust gas. The control unit 100 acquires the air fuel ratio of the exhaust gas flowing through the exhaust pipe 13 based on the amount of output current flowing through the upstream sensor 200 or the like.

Figure 3:
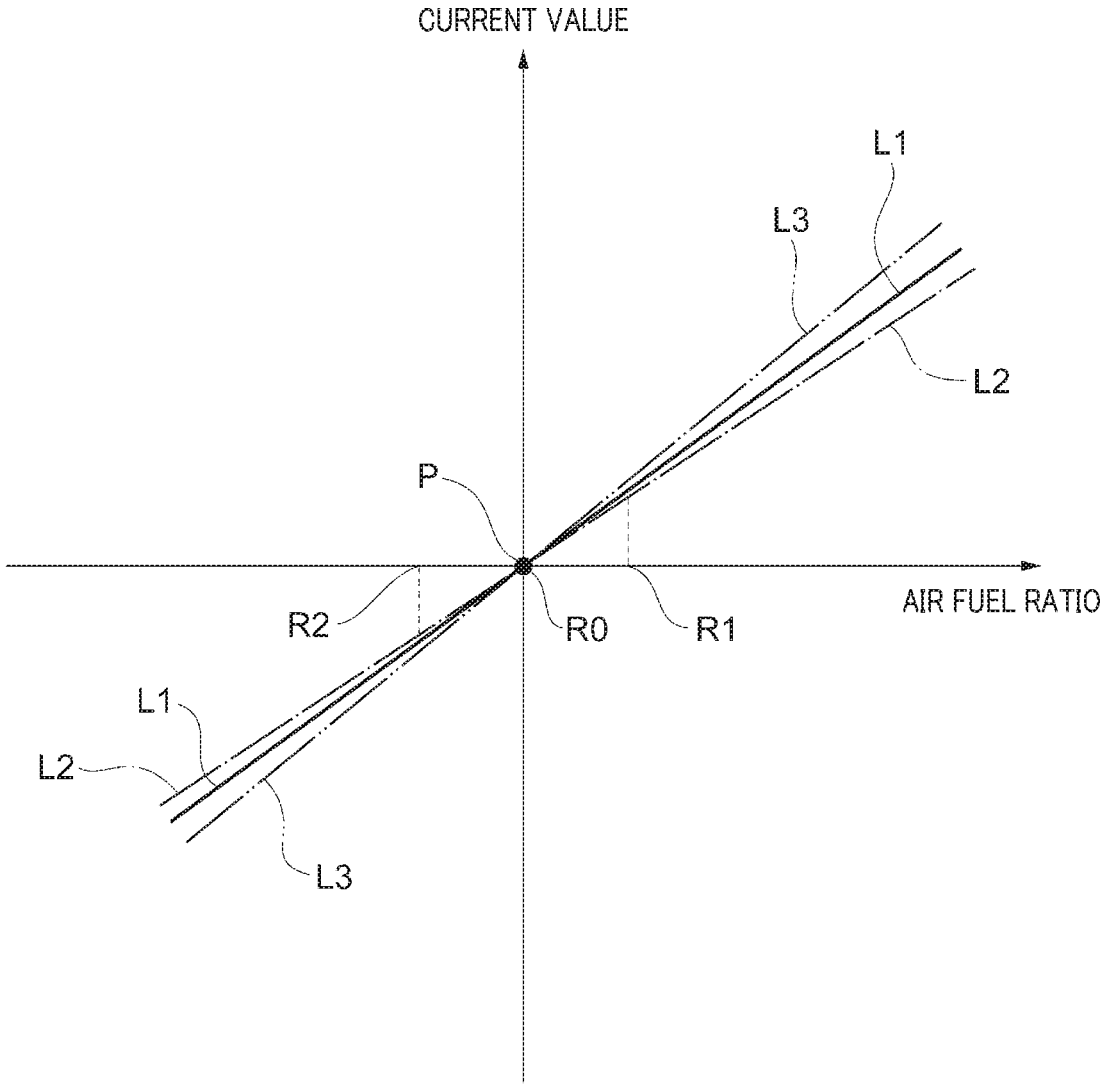
FIG. 3 is a diagram showing a relationship between the air fuel ratio of exhaust gas measured at the air fuel ratio sensor and the output current outputted from the air fuel ratio sensor.

FIG. 3 illustrates a relationship between the air fuel ratio of the exhaust gas (horizontal axis) and the above-described output current (vertical axis) with lines L1 to L3. The lines L1 to L3 show the amount of output current each measured at different upstream sensors 200, in which the output current of the upstream sensor 200 varies depending on individual differences of the sensors.

In FIG. 3, R0 represents theoretical air fuel ratio. R1 shown in FIG. 3 is an air fuel ratio being slightly to the lean side of the theoretical air fuel ratio. R2 shown in FIG. 3 is an air fuel ratio being slightly to the rich side of the theoretical air fuel ratio.

The point P shown in FIG. 3 is the theoretical air fuel ratio (R0) of the exhaust gas, representing that the output current is 0. Each of the lines L1 to L3 passes through the point P. In other words, the upstream sensor 200 has properties in which the output current reliably becomes 0 without being influenced by individual differences, when the air fuel ratio of the exhaust gas is the theoretical air fuel ratio. Such properties are present in the upstream sensor 200, because the upstream sensor 200 is configured as one cell structure as shown in FIG. 2. When assuming that the upstream sensor 200 is not configured as one cell structure but configured as a structure having a pump cell, the output current may not be 0 because of individual manufacturing differences, even when the air fuel ratio of the exhaust gas is the theoretical value. The upstream sensor 200 is configured to have one cell structure, whereby such a deviation of the output current is avoided.

In the case where the air fuel ratio of the exhaust gas is significantly deviated from the theoretical air fuel ratio, the output current of the exhaust gas is no longer proportional to the air fuel ratio of the exhaust gas. On the other hand, when the air fuel ratio of the exhaust gas is close to the theoretical air fuel ratio (i.e., value between R1 and R2 shown in FIG. 3), the output current is approximately proportional to the air fuel ratio of the exhaust gas. As shown in FIG. 3, when the air fuel ratio is somewhere between R1 and R2, variation in the measurement values among the lines 1 to 3 are small enough to be neglected. According to the upstream sensor 200 or the downstream sensor 300, the air fuel ratio in the vicinity of the theoretical air fuel ratio can be accurately measured, while avoiding the influence of individual differences.

Figure 4:
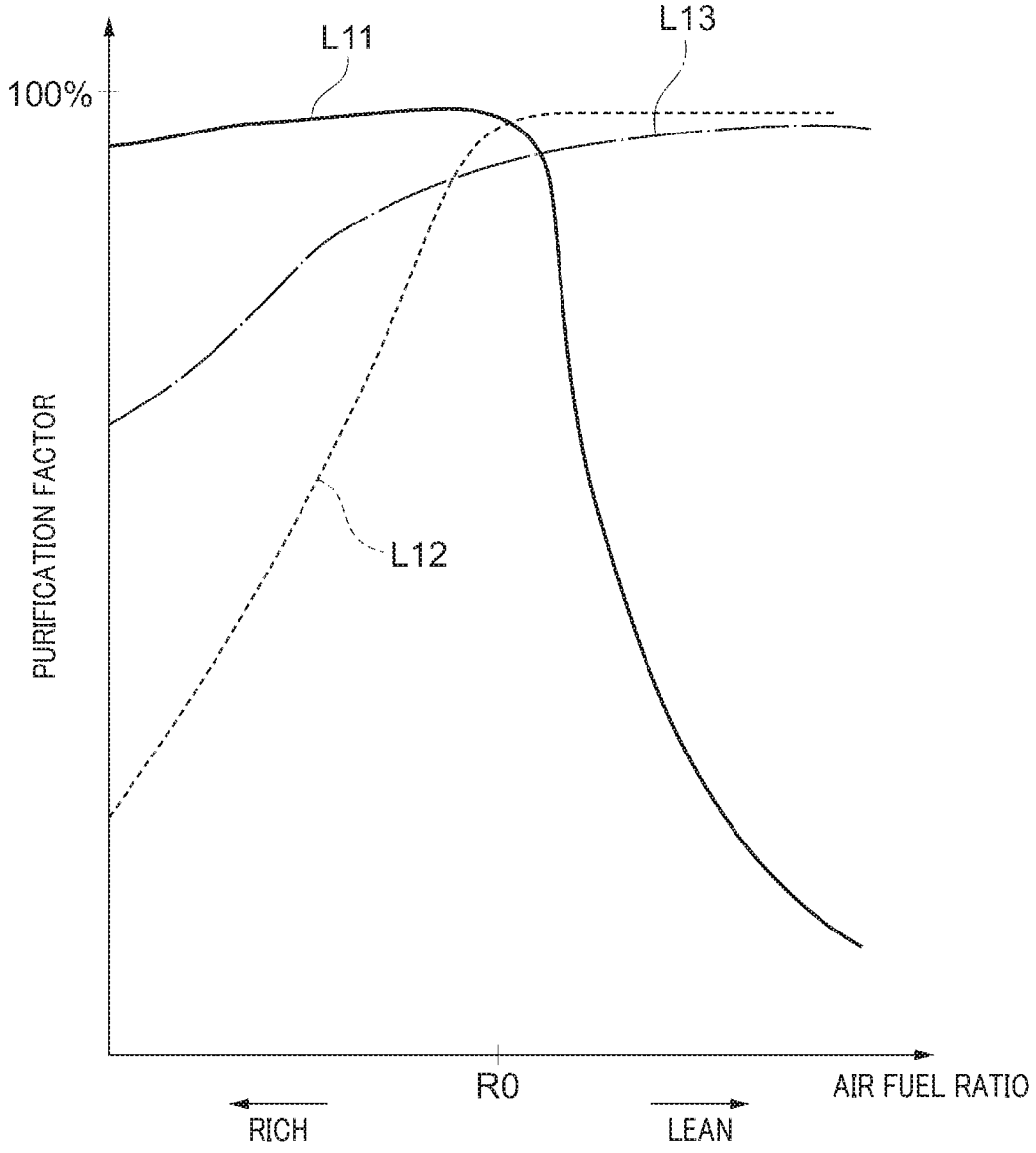
FIG. 4 is a graph showing the air fuel ratio of the exhaust gas passing through a purification catalyst and a purification factor of the purification catalyst.

With reference to FIG. 4, purification performance of the upstream side purification catalyst 14 and the downstream side purification catalyst will be described. Note that the upstream side purification catalyst will only be described since the upstream and downstream side purification catalysts are the same.

Line L11 indicates a relationship between an air fuel ratio (horizontal axis) of the exhaust gas passing through the upstream side purification catalyst 14 and a purification factor (vertical axis) of nitrogen oxides contained in the exhaust gas. Line L12 indicates a relationship between an air fuel ratio (horizontal axis) of the exhaust gas passing through the upstream side purification catalyst 14 and a purification factor (vertical axis) of carbon monoxides contained in the exhaust gas. Line L13 indicates a relationship between an air fuel ratio (horizontal axis) of the exhaust gas passing through the upstream side purification catalyst 14 and a purification factor (vertical axis) of hydrocarbon contained in the exhaust gas.

As indicated by the line L11, the purification factor of nitrogen oxides is large when the air fuel ratio of the exhaust gas is on the rich side and becomes small when the air fuel ratio of the exhaust gas exceeds the theoretical air fuel ratio (R0) to reach the lean side. As indicated by the lines L12 and L13, the purification factors of carbon monoxides and hydrocarbons indicate small when the air fuel ratio of the exhaust gas is on the rich side exceeding the theoretical air fuel ratio, and becomes larger as the air fuel ratio increases towards the lean side. As shown in FIG. 4, when the air fuel ratio of the exhaust gas passing through the upstream side purification catalyst 14 is around the theoretical air fuel ratio, purification factors of each of nitrogen oxides, carbon monoxides, and hydrocarbon shows high.

That is, the theoretical air fuel ratio can be referred to as an air fuel ratio where the purification performance by the upstream side purification catalyst 14 or the downstream side purification catalyst 15 are maximized, that is, an air fuel ratio of the highest purification efficiency. When the air fuel ratio of the exhaust gas passing through the upstream side purification catalyst 14 is the highest purification efficiency, the output current of the downstream sensor 300 is 0.

Figure 5:
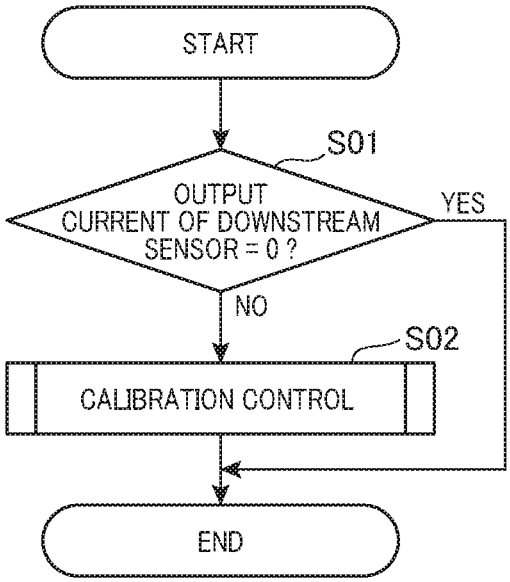
FIG. 5 is a flowchart illustrating a process executed by a control unit included in the air fuel ratio control apparatus.

With reference to FIG. 5, a process executed by the control unit 100 will be described. As described above, the control unit 100 controls the injector 12 to adjust an amount of fuel supplied to the internal combustion engine 11, thereby controlling the air fuel ratio measured at the upstream sensor 200 to be the target air fuel ratio. The control unit 100 repeatedly executes the series of processes shown in FIG. 5 at predetermined periods. These processes are executed separately from the above-described control process executed by the control unit 100.

At the first step S01, it is determined whether or not the output current of the downstream sensor 300 is 0. When the output current of the downstream sensor 300 is 0, the air fuel ratio of the exhaust gas passing through the upstream side purification catalyst 14 is at the highest purification efficiency, in which the purification of the exhaust gas in the upstream side purification catalyst 14 has appropriately performed. Hence, in this case, the process terminates the series of processes shown in FIG. 5 without executing the process at step S02.

When the output current of the downstream sensor 300 is not 0, the air fuel ratio passing through the upstream side purification catalyst 14 is deviated from the highest purification efficiency. This means that nitrogen oxides or the like are leaked towards the downstream side of the upstream side purification catalyst 14. Hence, in this case, the process proceeds to step S02 and performs a calibration process. The calibration process calibrates (changes) the target air fuel ratio such that the air fuel ratio of the exhaust gas passing through the upstream side purification catalyst corresponds to the highest purification efficiency.

Figure 6:
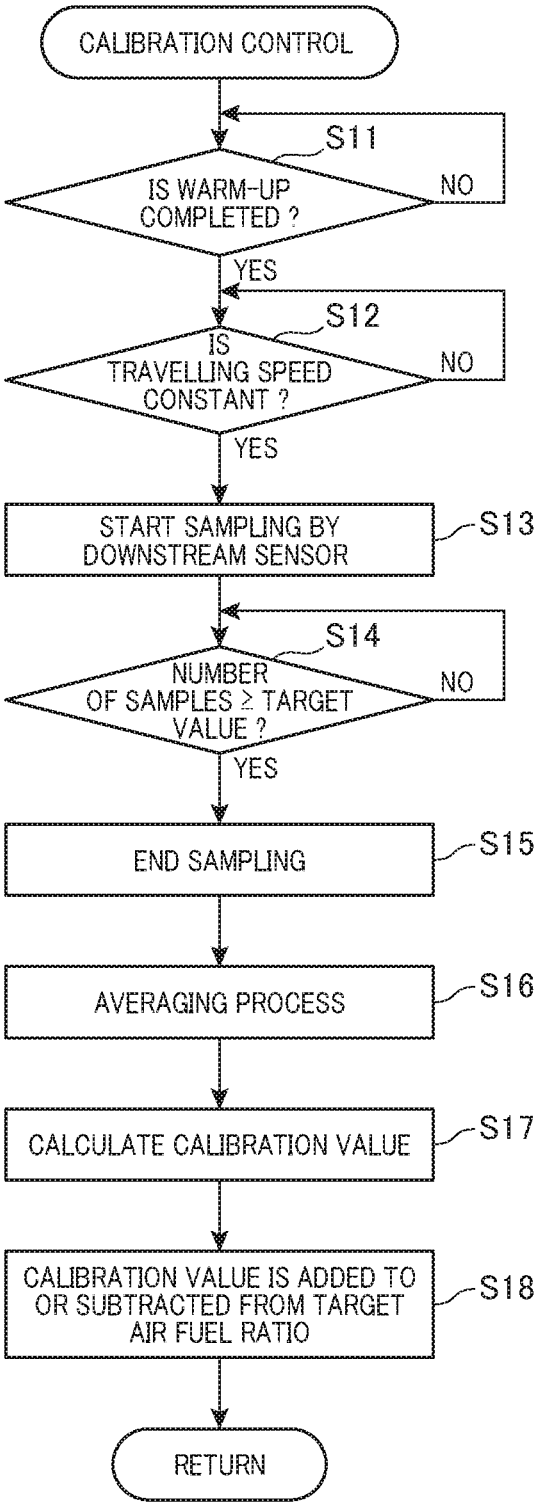
FIG. 6 is a flowchart illustrating a process executed by a control unit included in the air fuel ratio control apparatus.

With reference to FIG. 6, flow of the specific processes executed in the calibration process will be described. At the first step S11 in the calibration control, the process determines whether a warm-up of the internal combustion engine 11 has been completed or not. The process determines that the warm-up of the internal combustion engine 11 has been completed when the temperature of the cooling water circulating between the internal combustion engine 11 and the radiator (not shown) increases to a predetermined temperature (e.g., 65° C.) or higher. When the warm-up has not been completed, the process executes the process at step S11 again. When the warm-up has been completed, the process proceeds to step S12.

At step S12, the process determined whether a travelling state of the vehicle MV is stable or not. When the travelling speed measured at the vehicle speed sensor 16 is almost constant and within a predetermined range (e.g., ±5 km/h), the process determines that the travelling state of the vehicle MV is stable. When the travelling state is determined as unstable, the process executes the process at step S12 again. When the travelling state is stable, the process proceeds to step S13.

At step S13, the process starts sampling of a measurement value at the downstream sensor 300. The object to be sampled may be the output value from the downstream sensor 300, or the air fuel ratio value corresponding the output current, for example. According to the present embodiment, the output current of the downstream sensor 300 is sampled at 32 msec intervals, and stored the sampled value into a memory unit included in the control unit 100.

At step S14, the process determines whether the number of sampled values (i.e., the number of samples) is a predetermined target value or more. According to the present embodiment, 200 is set as the target value of the number of samples. When the number of samples is less than the target value, the process at step S14 is executed again. When the number of samples is more than the target value, the process proceeds to step S15. At step S15, a process for terminating the sampling is executed.

At step S16, the process performs an averaging process. The averaging process calculates an average value of the sampled value from the process at step S13.

At step S17, the process calculates a calibration value to be added to or subtracted from the target air fuel ratio. For the calculation of the calibration value, first, the output current value (i.e., 0 mA) corresponding to the air fuel ratio at the highest purification efficiency of the upstream side purification catalyst 14 is subtracted from the average value calculated at step S17 (average value of values measured by the downstream sensor 300). Thereafter, the process identifies the absolute value of the acquired value and converts the absolute value (current value) into the air fuel ratio, thereby acquiring the calibration value. The conversion of the absolute value (current value) to the air fuel ratio is performed based on a relationship indicated by the line L1 or the like shown in FIG. 3, for example.

Here, when defining a difference between the air fuel ratio measured at the downstream sensor 300 and the air fuel ratio at the highest purification efficiency in the purification catalyst, as "air fuel ratio deviation", the calibration value calculated as described above can be referred to as a value corresponding to the air fuel ratio deviation value.

At step S18, the calibration value calculated at step S17 is added to the target air fuel ratio, or subtracted from the target air fuel ratio. When the average value calculated at step S16 is a lean side value (positive side), the calibration value is subtracted from the target air fuel ratio. In other words, the target air fuel ratio is changed to be more rich side value than the present value. On the other hand, when the average value calculated at step S16 is in rich side (negative side), the calibration value is added to the target air fuel ratio. In other words, the target air fuel ratio is changed to be more lean side value than the present value.

When the process at step S18 is performed, the series of processes shown in FIG. 6 is terminated. Thereafter, an amount of fuel supplied to the internal combustion engine 11 is adjusted such that the air fuel ratio measured at the upstream sensor 200 becomes the calibrated target air fuel ratio.

Figure 7A:
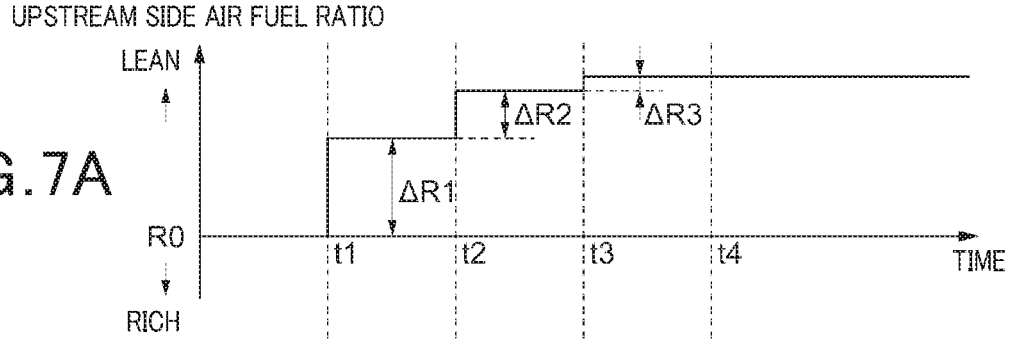
FIGS. 7A to 7D are a set of timing diagram illustrating a change in the air fuel ratio or the like which are measured at the air fuel ratio sensor.
Figure 7B:
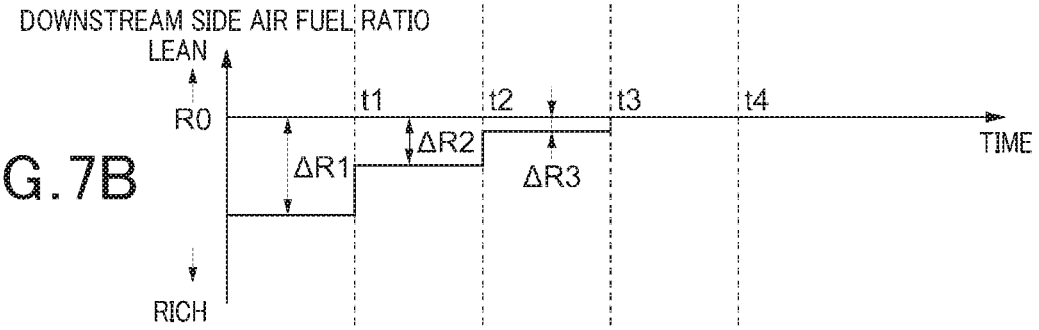
Figure 7C:
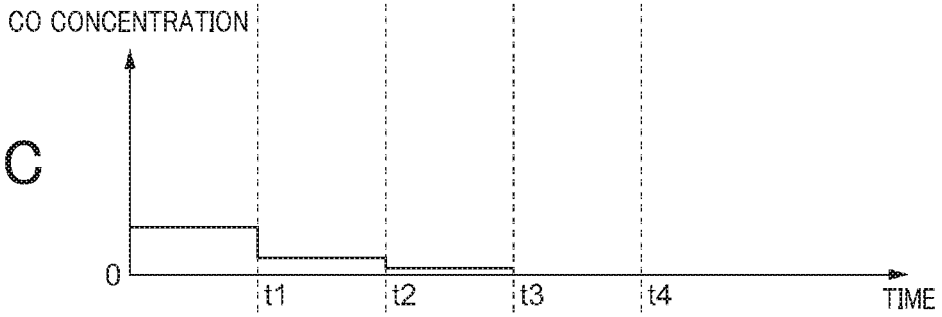
Figure 7D:
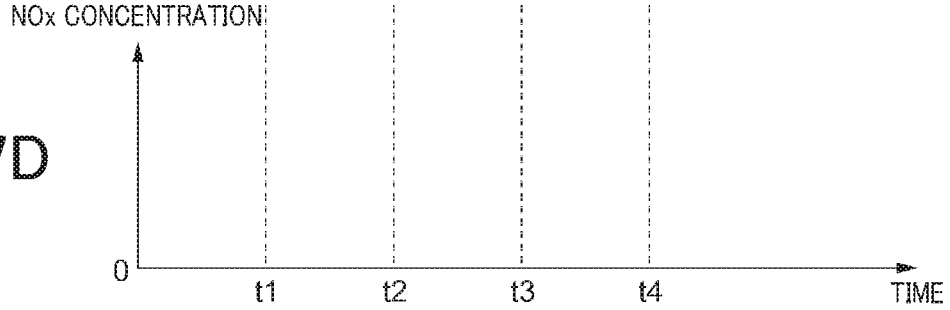

With reference to FIGS. 7A to 7D, a change in the air fuel ratio when the above-described processes are performed will be described. FIG. 7A shows a change in the air fuel ratio measured at the upstream sensor 200. FIG. 7B shows a change in the air fuel ratio measured at the downstream sensor 300. FIG. 7C shows a change in the concentration of carbon monoxides contained in the exhaust gas passing through the downstream sensor 300. FIG. 7D shows a change in the concentration of nitrogen oxides contained in the exhaust gas passing through the downstream sensor 300.

In an example shown in FIGS. 7A to 7D, the first calibration control is executed at time t1. Since the target air fuel ratio is set to be the theoretical air fuel ratio R0 prior to the time t1, the air fuel ratio measured at the upstream sensor 200 is approximately the same as the theoretical air fuel ratio R0 (FIG. 7A). However, the air fuel ratio measured at the downstream sensor 300 is deviated towards the rich side by AR1 from the theoretical air fuel ratio R0 corresponding to the highest purification efficiency (FIG. 7B). Such a deviation is caused by deterioration of the upstream side purification catalyst 14 or lack of oxygen occlusion quantity, for example.

In the calibration control executed at time t1, the above-mentioned AR1 is calibrated. After the time t1, the control shifts the current target air fuel ratio towards the lean side by AR1, and sets the shifted target air fuel ratio to be the latest target air fuel ratio. Hence, the air fuel ratio measured at the upstream sensor 300 after the time t1 is a value in which ΔR1 is added to the theoretical air fuel ratio R0 (FIG. 7A).

As the calibration value which is added to or subtracted from the target air fuel ratio in the calibration control, the air fuel ratio deviation is utilized without any change in the present embodiment. Such a calibration value can be referred to as an optimized value that allows the air fuel ratio deviation to be close to 0. Hence, theoretically, the air fuel ratio measured at the downstream sensor 300 after the timing t1 at which the calibration control is performed has to be the theoretical air fuel ratio R0 (highest purification efficiency).

However, practically, the air fuel ratio deviation is likely to be present even after the time t1 because of an error of the fuel injection quantity in the injector 12 or a delay of a change in the air fuel ratio. As an example shown in FIG. 7, the air fuel ratio deviation after time t2 is shown as ΔR2 which is smaller than ΔR1.

Therefore, at the time t2, the calibration control is executed again. After the time t2, the present target air fuel ratio (i.e., theoretical air fuel ratio R0+ΔR1) is further shifted towards lean side by ΔR2 to be set as the latest target air fuel ratio.

These calibration controls are repeatedly executed until the air fuel ratio measured at the downstream sensor 300 reaches the highest purification efficiency, that is, step S01 is determined as Yes. According to the example shown in FIG. 7, third time calibration control is executed at time t3, whereby the air fuel ratio measured at the downstream sensor 300 is the highest purification efficiency. Therefore, the calibration control is not executed at time t4 which follows the time t3.

As a result of repeated calibration controls as described above, the concentration of carbon monoxides at the downstream sensor 300 is reduced stepwisely and shows nearly 0 after the time t3 (FIG. 7C).

Note that FIG. 7C is an example where the air fuel ratio measured at the downstream sensor 300 is deviated towards rich side so that concentration of nitrogen oxides at the downstream sensor 300 stays at nearly 0 (FIG. 7D). Conversely, in the case where the air fuel ratio of the air fuel ratio measured at the downstream sensor 300 is deviated towards lean side, the concentration of nitrogen oxides approaches stepwisely 0.

As described above, the control unit 100 of the air fuel ratio control unit 10 according to the present embodiment is configured to perform a calibration control in which a calibration value corresponding to the air fuel ratio deviation is added to or subtracted from the target air fuel ratio such that the air fuel ratio deviation approaches to 0. Thus, these calibration controls allow the air fuel ratio measured at the downstream sensor 300 to reach the highest purification efficiency in a short period of time.

Further, immediately after the calibration control is performed for one or more times, the air fuel ratio of the exhaust gas passing through the upstream side purification catalyst 14 corresponds to the highest purification efficiency of the upstream side purification catalyst 14. Hence, it takes longer time to the next occurrence of a phenomena in which the air fuel ratio of the exhaust gas is deviated from the highest purification efficiency. As a result, frequency of occurrence of the phenomena in which the air fuel ratio of exhaust gas passing through the upstream side purification catalyst 14 is deviated from the highest purification efficiency of the upstream side purification catalyst 14 can be lower than that of conventional technique.

Thus, since an amount of nitrogen oxides or the like leaked towards downstream side of the upstream purification catalyst 14 is reduced, the downstream side purification catalyst 14 can be smaller than that of the conventional technique.

According to the present embodiment, the calculated air fuel ratio deviation can be used as "calibration value corresponding to the air fuel ratio deviation" without any change. Instead of using such an aspect, a value in which a predetermined calibration factor is multiplied by the calculated air fuel ratio deviation may be utilized. In other words, a value in which a predetermined calibration factor is multiplied by the measurement value at the downstream sensor 300 may be utilized to calculate the calibration value. For example, in the case where detection error occurs in a detection circuit that detects the output current of the downstream sensor 300, the above-mentioned calibration factor can be set, thereby errors can be cancelled.

Even when the above-described detection error is a problem, a process may be performed to reset the detected output current value at a time when turning the power of the vehicle MV ON (e.g., immediately before starting the internal combustion engine 11).

The control unit 100 in the present embodiment calculates the calibration value using an average value of a plurality of measured values at the downstream sensor 300 (steps S16 and S17). Thus, the control unit 100 is able to calculate an appropriate value as an air fuel ratio deviation and a calibration value even when the measurement values vary at the downstream sensor 300. When the above-described detection error is not a problem, the calibration value can be calculated based on a single measurement value at step S17 shown in FIG. 6. That is, the target value of the number of samples set at step S14 may be 1.

The control unit 100 in the present embodiment is designed to execute the calibration control when the travelling state of the vehicle MV is stable, that is, when a variation of the traveling speed of the vehicle MV is within a predetermined range (step S12 shown in FIG. 6). Thus, the air fuel ratio deviation can be accurately calculated under a condition in which the combustion state in the internal combustion engine 11 is stable so that more appropriate calibration of the target air fuel ratio value can be achieved. The determination whether the travelling state of the vehicle MV is stable or not may be based on an index other than the travelling state.

Second Embodiment

Figure 8:
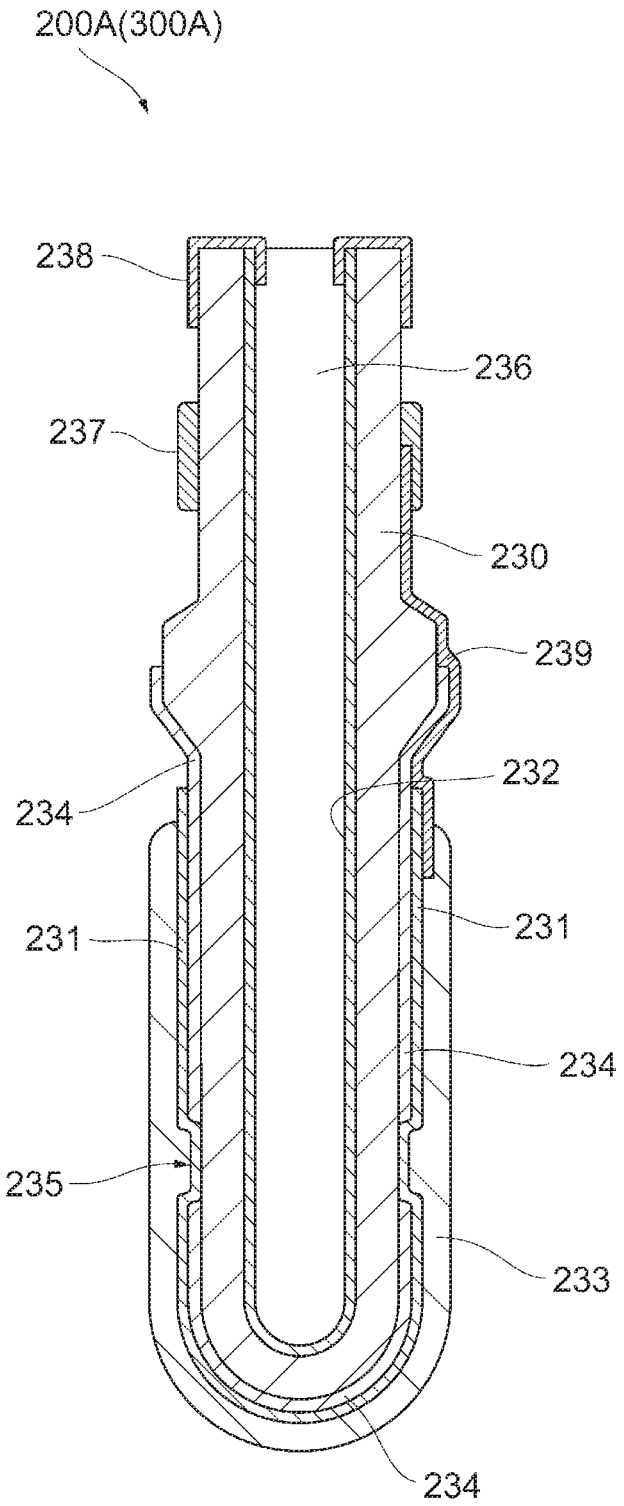
FIG. 8 is a diagram showing an internal configuration of the air fuel ratio sensor included in the air fuel ratio control apparatus according to a second embodiment of the present disclosure.

With reference to FIG. 8, a second embodiment will be described. The air fuel ratio control apparatus 10 according to the second embodiment differs from the first embodiment in the configuration of the upstream sensor 200A and the downstream side 300A, and other configuration and aspect of the control are the same as the first embodiment. The configuration of the upstream sensor 200A and the configuration of the downstream sensor 300A. Accordingly, only the configuration of the upstream sensor 200A will be described, and explanation of other configurations will be omitted.

FIG. 8 is a cross-sectional view illustrating an upstream sensor 200A according to the second embodiment. The upstream sensor 200A is configured of one cell structure similar to that of the first embodiment (FIG. 2). However, according to the second embodiment, the upstream sensor 200A is not configured of the plate-type sensor, but configured of glass-shape sensor. Note that the configuration of the upstream sensor 200A is the same as the sensor disclosed by Japanese Patent Application Laid-open Publication No. 1998-82760

The upstream sensor 200A includes a solid electrolyte body 230, the operation electrode 211 and the reference electrode 232.

The solid electrolyte body 230 is a member formed in a substantially cylindrical shape and made of a material of $ZrO_2$—$Y_2O_3$. The solid electrolyte body 230 has oxygen ion conductivity at a predetermined activation temperature. The solid electrolyte body 230 is opened at one end in the longitudinal direction (upper end in FIG. 8) and the other end is closed. An air passage 236 is formed in the solid electrolyte body 230, which is a space isolated from the exhaust passage 13. The outside air is introduced into the air passage 216.

The operation electrode 231 is a layer formed on an outside surface of the solid electrolyte 230. The operation electrode 231 is formed of a porous layer which is made of platinum or the like. Thus, the operation electrode 231 has both of electrical conductivity and permeability.

A sensor part 235 is provided in the vicinity of a closed lower end part in the solid electrolyte body 230. In the sensor part 235, the operation electrode 231 is directly formed on the surface of the solid electrolyte 230. In the other part in the solid electrolyte body 230, an electrical isolation layer 234 is interposed between the surface of the solid electrolyte 230 and the operation electrode 231. In such a configuration, oxygen ions pass only through the sensor part 235 in the solid electrolyte body 230.

The outer periphery surface of the operation electrode 231 is covered by a diffusion resistance layer 233 having porosity. The exhaust gas passing through the exhaust passage 13 reaches the solid electrolyte 230 via the diffusion resistance layer 233 and the operation electrode 231 in the sensor part 235.

The reference electrode 232 is a layer formed on the inner surface of the solid electrolyte body 230. Similarly, the reference electrode 232 is formed of a porous layer which is made of platinum or the like. Hence, the reference electrode 232 has both of electrical conductivity and permeability.

As described, outside air is introduced in the air passage 236. Hence, the solid electrolyte body 230 is exposed to the exhaust gas passing through the exhaust passage 13 at the outer surface thereof, and exposed to the outside air at the inner surface thereof. In the sensor part 235 of the solid electrolyte 230, transportation of oxygen ions occurs due to the difference of oxygen concentrations between respective surfaces thereof.

The terminal portions 237 and 238 are provided in the vicinity of the upper end portion which is opened in the solid electrolyte body 230. These terminal portions are each formed of platinum plating. The terminal portion 237 is connected to the operation electrode 231 via a lead portion 239. The terminal portion 238 is directly connected to the reference electrode 232.

When the air fuel ratio is measured at the upstream sensor 200A, a predetermined voltage is applied between the terminal portion 237 and the terminal portion 238, that is, between the operation electrode 231 and the reference electrode 232. At this moment, in the sensor part 235 of the solid electrolyte body 230, transportation of oxygen ions occurs due to the difference of oxygen concentrations between the operation electrode 231 side (i.e., oxygen concentration in the exhaust gas) and the reference electrode 232 side (i.e., oxygen concentration of atmospheric air). As a result, current (output current) proportional to the air fuel ratio of the exhaust gas flows between the terminal portion 237 and the terminal portion 238. Thus, each of the upstream sensor 200A and the downstream sensor 300A is configured such that the output current varies to be proportional to the air fuel ratio of the exhaust gas. The control unit 100 calculates the air fuel ratio of the exhaust gas flowing through the exhaust passage 13 based on an amount of output current flowing through the upstream sensor 200A or the like.

As sensors to measure the air fuel ratio, the above-described upstream sensor 200A and the downstream sensor 300A can be used to obtain the same effects described in the first embodiment. These upstream sensor 200A and the downstream sensor 300A may be configured as the same configuration. However, mutually different configurations may be used for these upstream sensor 200A and the downstream sensor 300A.

Embodiments of the present disclosure have been described with specific examples. However, the present discourse is not limited to those specific examples. A person ordinary skilled in the art may perform a design change in accordance with those specific examples and this change can be included in the scope of the present disclosure as long as features of the present disclosure are included therein. An arrangement, a condition, a shape of each elements included in the specific examples is not limited to the one shown in the above described embodiments. However, any modifications can be made. Respective elements included in the above-described specific examples can be combined as long as any technical inconsistency is not present.

What is claimed is:

1. An air fuel ratio control apparatus controlling an air fuel ratio of an internal combustion engine, the apparatus comprising:

an upstream sensor measuring the air fuel ratio of an exhaust gas in an exhaust passage at an upstream side of a purification catalyst purifying the exhaust gas, the exhaust gas being discharged from the internal combustion engine and passing through the exhaust passage;

a single downstream sensor measuring the air fuel ratio of the exhaust gas in the exhaust passage at a downstream side of the purification catalyst; and a control unit that adjusts an amount of fuel supplied to the internal combustion engine, thereby controlling the air fuel ratio measured at the upstream sensor to be a target air fuel ratio, wherein an air fuel ratio deviation is defined as a difference between the air fuel ratio measured by the single downstream sensor and an air fuel ratio corresponding to a highest purification efficiency in the purification catalyst; and the control unit is configured to perform a calibration control in which the target air fuel ratio is calibrated, the calibration control for calibrating the target air fuel ratio using a calibration value corresponding to the air fuel ratio deviation to add to or subtract from the target air fuel ratio to change the target air fuel ratio such that the air fuel ratio deviation approaches to 0.

2. The air fuel ratio control apparatus according to claim 1, wherein the control unit is configured to calculate the calibration value using an average value of a plurality of measured values at the single downstream sensor.

3. The air fuel ratio control apparatus according to claim 1, wherein the control unit is configured to calculate the calibration value using a value in which a predetermined calibration factor is multiplied by a value measured at the single downstream sensor.

4. The air fuel ratio control apparatus according to claim 1, wherein each of the upstream sensor and the single downstream sensor is configured to change an output current thereof to be proportional to the air fuel ratio of the exhaust gas.

5. The air fuel ratio control apparatus according to claim 4, wherein the air fuel ratio corresponding to the highest purification efficiency is defined as an air fuel ratio at which the output current of the single downstream sensor is 0.

6. The air fuel ratio control apparatus according to claim 4, wherein each of the upstream sensor and the single downstream sensor is configured to have one-cell structure.

7. The air fuel ratio control apparatus according to claim 1, wherein the control unit is configured to perform the calibration control when a travelling state of a vehicle provided with the internal combustion engine is stable.

8. The air fuel ratio control apparatus according to claim 7, wherein a travelling speed of the vehicle being within a predetermined range indicates that the travelling state of the vehicle is stable.

9. The air fuel ratio control apparatus according to claim 1, wherein the purification catalyst forms a first purification catalyst such that the upstream sensor is arranged at the upstream side of the first purification catalyst and the single downstream sensor is arranged at the downstream side of the first purification catalyst; and the single downstream sensor is arranged between the first purification catalyst and a second purification catalyst, the second purification catalyst being positioned downstream of the first purification catalyst in the exhaust passage.

10. The air fuel ratio control apparatus according to claim 1, wherein the control unit is configured to repeatedly perform the calibration control until the air fuel ratio measured by the downstream sensor reaches the air fuel ratio corresponding to the highest purification efficiency in the purification catalyst.

* * * * *